US010616675B2

(12) United States Patent
Sondergaard et al.

(10) Patent No.: US 10,616,675 B2
(45) Date of Patent: Apr. 7, 2020

(54) EARPHONE

(71) Applicant: GOERTEK INC., Weifang, Shandong (CN)

(72) Inventors: Morten Birkmose Sondergaard, Weifang (CN); Sune Lonbaek Olsen, Weifang (CN); Frederik Skovgaard, Weifang (CN); Andrew Paddock Bright, Weifang (CN); Rui Du, Weifang (CN)

(73) Assignee: GOERTEK INC., Shandong (CN)

( * ) Notice: Subject to any disclaimer, the term of this patent is extended or adjusted under 35 U.S.C. 154(b) by 0 days.

(21) Appl. No.: 16/064,402

(22) PCT Filed: Oct. 27, 2016

(86) PCT No.: PCT/CN2016/103478
§ 371 (c)(1),
(2) Date: Jun. 20, 2018

(87) PCT Pub. No.: WO2018/076221
PCT Pub. Date: May 3, 2018

(65) Prior Publication Data
US 2019/0373354 A1 Dec. 5, 2019

(51) Int. Cl.
*H04R 1/10* (2006.01)
*H01R 13/56* (2006.01)
*H04R 1/28* (2006.01)

(52) U.S. Cl.
CPC ..... *H04R 1/1033* (2013.01); *H01R 13/562* (2013.01); *H04R 1/1016* (2013.01); *H04R 1/1058* (2013.01); *H04R 1/2826* (2013.01)

(58) Field of Classification Search
CPC .. H04R 1/1033; H04R 13/562; H04R 1/1016; H04R 1/1058; H04R 1/2826
USPC ..... 381/380
See application file for complete search history.

(56) References Cited

U.S. PATENT DOCUMENTS

2005/0147269 A1 7/2005 Oliveira et al.
2012/0257780 A1* 10/2012 Huang ..... H04R 1/1033 381/380
2013/0343593 A1* 12/2013 Howes ..... H04R 1/1016 381/380
2013/0343595 A1* 12/2013 Zorkendorfer ..... H04R 1/10 381/380

FOREIGN PATENT DOCUMENTS

CN 102300138 A 12/2011
CN 203813934 U 9/2014
CN 204350244 U 5/2015
CN 204425579 U 6/2015
CN 205017511 U 2/2016

* cited by examiner

*Primary Examiner* — Sean H Nguyen
(74) *Attorney, Agent, or Firm* — Jacob M. Ward; Ward Law Office LLC

(57) ABSTRACT

The present invention discloses an earphone. The earphone comprises: an earbud, wherein a cable comes out from an open end of a stem of the earbud; and a strain relief element mounted at the open end, the material of which is softer than that of the stem. The strain relief element contains a cable tube where the cable passes through and the inner wall of the cable tube fits the cable in a close manner. According to an embodiment of this invention, the present invention can provide a better strain relief effect.

13 Claims, 4 Drawing Sheets

EARPHONE

CROSS-REFERENCE TO RELATED APPLICATIONS

This application is a National Stage of International Application No. PCT/CN2016/103478, filed on Oct. 27, 2016, which is hereby incorporated by reference in its entirety.

FIELD OF THE INVENTION

The present invention relates to the field of electronics, and more specifically, to an earphone.

BACKGROUND OF THE INVENTION

An earphone or in-ear headphone is widely used for an electronics apparatus such a mobile phone, laptop, pad and so on.

It is convenient for a user to carry an earphone and use it without disturbing others. However, the earphone is easily broken or cracked, especially at the junction where the cable comes out of the earbud.

In the prior art, a strain relief is provided to an earphone for protection. Generally, the strain relief is provided at the junction between the stem of an earbud and the cable thereof. However, current strain reliefs prove insufficient in many cases. For example, the strain relief element surrounds the cable in a loose manner so that they cannot effectively protect the cable from being broken at the junction with the earbud. Furthermore, the shape of the strain relief element is limited to the shape of the cable. The cross-section of the strain relief element is required to be in a round or ring shape.

SUMMARY OF THE INVENTION

In view of the above, an earphone is provided according to the embodiments of this invention so as to address at least one of the problems in the prior art.

According to a first aspect of the present invention an earphone is provided comprising: an earbud, wherein a cable comes out from an open end of a stem of the earbud; and a strain relief element mounted at the open end, the material of which is softer than that of the stem, wherein the strain relief element has a cable tube, the cable passes through the cable tube, and the inner wall of the cable tube fits the cable in a close manner.

Optionally or alternatively, the earphone further comprises an assembly element, which connects the stem and the strain relief element and the material of which is harder than that of the strain relief element.

Optionally or alternatively, the assembly element surrounds the cable and clamps the cable.

Optionally or alternatively, the assembly element is glued to the strain relief element or is moulded with strain relief element integrally.

Optionally or alternatively, one part of the assembly element is inside the stem and another part of the assembly element is inside the strain relief element.

Optionally or alternatively, the strain relief element has at least one bass tube which communicates with at least one bass tube of the earbud.

Optionally or alternatively, the earphone further comprises an acoustic filter placed in the bass tube, wherein the acoustic filter is placed between the assembly element and the stem of the earbud and is carried by the assembly element. For example, the acoustic filter is fixed by the assembly element to the stem.

Optionally or alternatively, the stem and strain relief element includes two or more bass tubes (which are symmetric with respect to the middle line traversing the cable tube of the strain relief element).

Optionally or alternatively, the bass tube of the strain relief element is aligned with the bass tube in the stem through the assembly element.

Optionally or alternatively, the strain relief element is of a size equal to or larger than that of the stem of the earbud at its open end.

Optionally or alternatively, the strain relief element continues the external geometric lines from the stem of the earbud.

Optionally or alternatively, the material of the strain relief element is rubber, the materials of the stem and assembly element are plastic.

According to an embodiment of this invention, the present invention can provide a better strain relief effect.

Further features of the present invention and advantages thereof will become apparent from the following detailed description of exemplary embodiments according to the present invention with reference to the attached drawings.

BRIEF DESCRIPTION OF THE DRAWINGS

The accompanying drawings, which are incorporated in and constitute a part of the specification, illustrate embodiments of the invention and, together with the description thereof, serve to explain the principles of the invention.

DETAILED DESCRIPTION OF THE EMBODIMENTS

Figure 1:
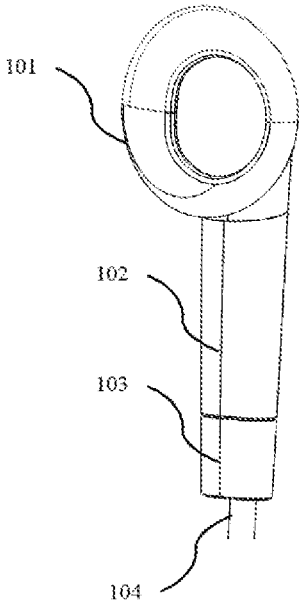
FIG. 1 is a schematic front view of an earphone according to an embodiment of the present invention.

Various exemplary embodiments of the present invention will now be described in detail with reference to the drawings. It should be noted that the relative arrangement of the components and steps, the numerical expressions, and numerical values set forth in these embodiments do not limit the scope of the present invention unless it is specifically stated otherwise.

The following description of at least one exemplary embodiment is merely illustrative in nature and is in no way intended to limit the invention, its application, or uses.

Techniques, methods and apparatus as known by one of ordinary skill in the relevant art may not be discussed in detail but are intended to be part of the specification where appropriate.

In all of the examples illustrated and discussed herein, any specific values should be interpreted to be illustrative only and non-limiting. Thus, other examples of the exemplary embodiments could have different values.

Notice that similar reference numerals and letters refer to similar items in the following figures, and thus once an item is defined in one figure, it is possible that it need not be further discussed for following figures.

Embodiments and examples will be described with reference to the drawings.

Figure 2:
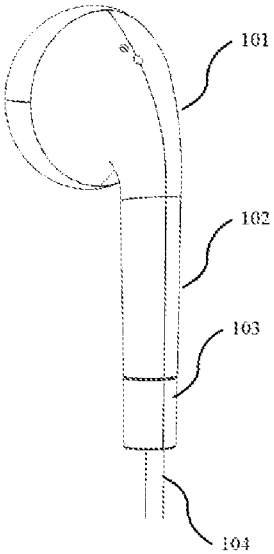
FIG. 2 is a schematic view showing the back of the earphone of FIG. 1.

FIG. 1 shows a schematic front view of an earphone according to an embodiment of the present invention. FIG. 2 shows a schematic view showing the back of the earphone of FIG. 1.

As shown in FIGS. 1 and 2, the earphone comprises an earbud 101, a strain relief element 103 and a cable 104. The earbud 101 has a stem 102. The cable 104 comes out from an open end of the stem 102 of the earbud 101. The strain relief element 103 is amounted at the open end. The material of the strain relief element 103 is softer than that of the stem 102. For example, the material of the strain relief element 103 is rubber and the material of the stem 102 is plastic. The strain relief element 103 provides a soft stiffness transition between the soft cable and the hard earbud shell (the stem).

The strain relief element 102 has a cable tube. The cable 104 passes through the cable tube, and the inner wall of the cable tube fits the cable 104 in a close manner.

Because the strain relief element is directly in contact with the cable, a close contact can still be ensured between the strain relief element and the cable even when the strain relief or the cable sway or rotate due to external force, and the strain on the cable will be dispersed into the strain relief element sufficiently. The strain relief element will give stronger support to the cable and can effectively protect the cable from being broken, especially at the junction.

In the prior art, the strain reliefs are limited to the external geometry of the cable and the internal geometry of the stem of an earbud. However, as shown in FIGS. 1 and 2, the strain relief element 103 continues the external geometric lines from the stem 102 of the earbud 101. As would be appreciated by those skilled in the art, the strain relief element 103 can have a size equal to or larger than that of the stem 102 of the earbud 101 at its open end.

In this way, the strain relief element in FIGS. 1 and 2 is not limited to the external geometry (round shape) of the cable and/or the internal geometry of the earbud, such as the opening of the stem 102. It can give a designer of earphone more freedom of design. Furthermore, the shape of the earphone will be aesthetically pleasing.

In addition, the thickness of the strain relief element may be larger than that of the prior art. This will make it more reliable. It may provide a relatively stable support to the cable.

Figure 3:
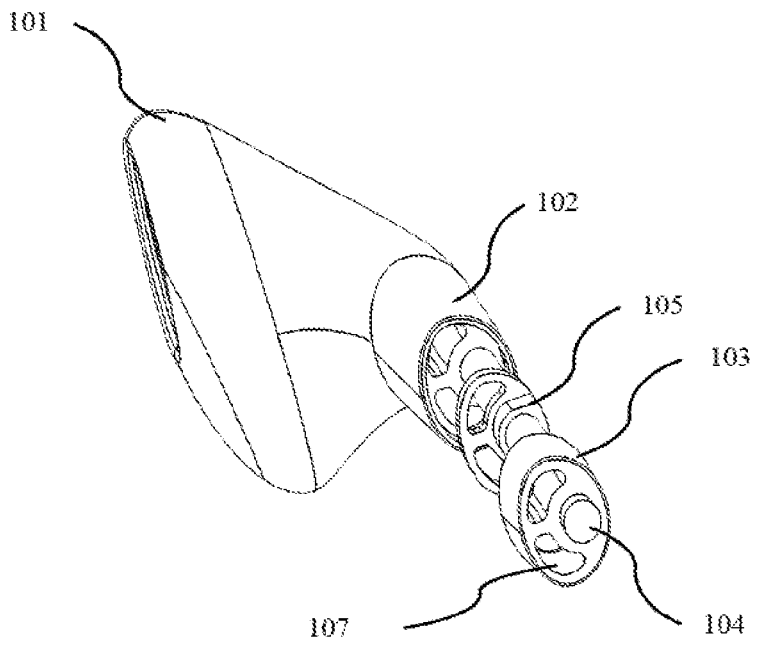
FIG. 3 is a schematic perspective view showing the earphone according to an embodiment of the present invention.

FIG. 3 is a schematic perspective view showing the earphone according to an embodiment of the present invention. FIG. 3 shows some cross-section views of the internal structure of the earphone.

As shown in FIG. 3, the earphone further comprises an assembly element 105. The assembly element 105 is placed between the earbud 101 and the strain relief element 103. It connects the stem 102 and the strain relief element 103. The material of assembly element 105 is harder than that of the strain relief element 103. It can also be plastics. The assembly element 105 can be glued to the strain relief element. Optionally, the assembly element 105 is moulded to the stem 102.

For example, one part of the assembly element 105 is inside the stem 102 and another part of the assembly element 105 is inside the strain relief element 103. The assemble element 105 makes it easier to assemble the strain relief element onto the earbud.

In addition, the assembly element 105 surrounds the cable and clamps the cable. The assembly element 105 may be used to fix the cable.

Furthermore, the assembly element 105 can be a separate component from the stem and the strain relief element. Thus, it can provide a transition between the stem and the strain relief element. In this way, it can avoid a sudden stiffness transition from the stem to the strain relief element, which may be helpful to the dispersion of the strain in the cable. Preferably, the material of the assembly element is harder than that of the strain relief element and is softer than that of the stem.

The assembly element 105 helps the strain relief element of the earbud become free from the size constraints of the stem section. For example, the strain relief element is of a size equal to or larger than that of the stem of the earbud at the open end of the stem. When it is equal, the strain relief element can still continue the external geometric lines from the stem of the earbud. This design freedom allows for a design which performs better in terms of stress dissipation. The solution also allows for a continuous bass tube section in the earbud.

As shown in FIG. 3, the strain relief element 103 further has two bass tubes 107 and cross sections of both bass tubes are symmetrical in shape and of curved outlines. However, the solution of the embodiment of the present invention can accommodate any number of bass tubes and different bass tube cross sections.

The bass tube 107 communicates with at least one bass tube of the earbud 102.

For example, the bass tube 107 in the strain relief element 103 has the same cross-section as that in the stem 102. Further, when a bass tube in the strain relief element connects with a bass tube in the stem, it has the same cross-section throughout the length of one bass tube in the strain relief element and the connected bass tube in the stem. In this regard, the bass tube 107 is constant throughout the earphone, which may lead to a better performance.

By providing a bass tube in the strain relief element, the length of the bass tube can be increased, compared with that in an earbud of the same size. From another aspect, it is possible to shorten the size of the earbud with a similar effect of bass tube.

By using the assembly element 105, a design freedom is provided to a designer. For example, it can provide a better performance of stress dispersion or make it easier to include one or more bass tubes in the strain relief elements.

Figure 4:
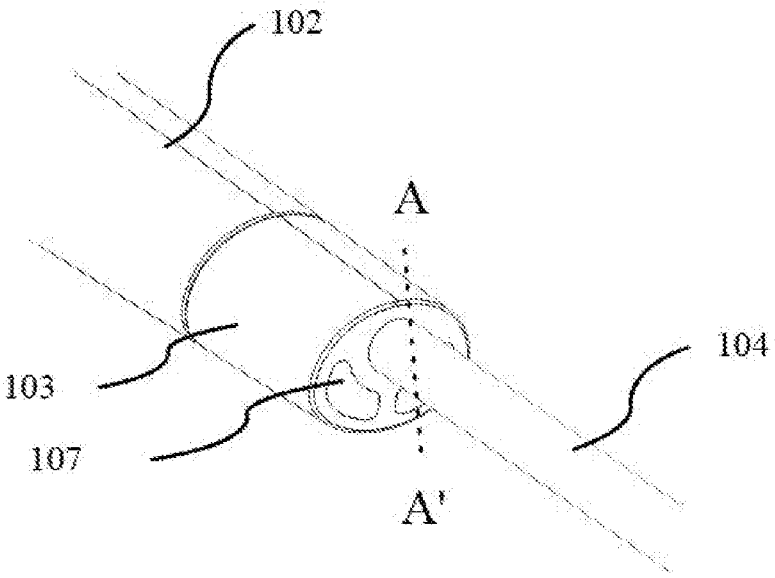
FIG. 4 is a schematic perspective view showing a strain relief element of the earphone according to an embodiment of the present invention.
Figure 5:
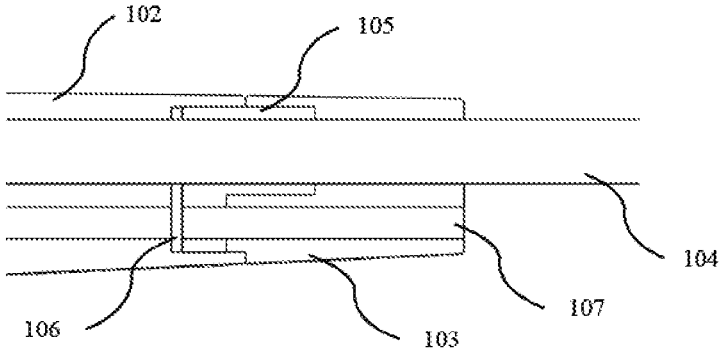
FIG. 5 is a schematic cross-section view taken from the line A-A' in FIG. 4.

FIG. 4 shows a schematic perspective view showing a strain relief of the earphone according to an embodiment of the present invention. FIG. 5 shows a schematic cross-section view taken from the line A-A' (a split-line of a front housing of the earbud) in FIG. 4.

As shown in FIG. 5, one part of the assembly element 105 is inside the stem 102 and another part of the assembly element 105 is inside the strain relief element 103. The assembly element 105 surrounds the cable and clamps the cable 104. The assembly element 105 can fasten the cable to the stem or the strain relief element.

The bass tube 107 goes from the stem 102 through the assembly element 105 and the strain relief element 103 to the outside.

In an example, an acoustic filter 106 is placed in the bass tube 107. The acoustic filter 106 is placed between the assembly element 105 and the stem 102 of the earbud 101 and is carried by the assembly element 105. For example, the acoustic filter 106 is fixed by the assembly element 105 to the stem 102.

Figure 6:
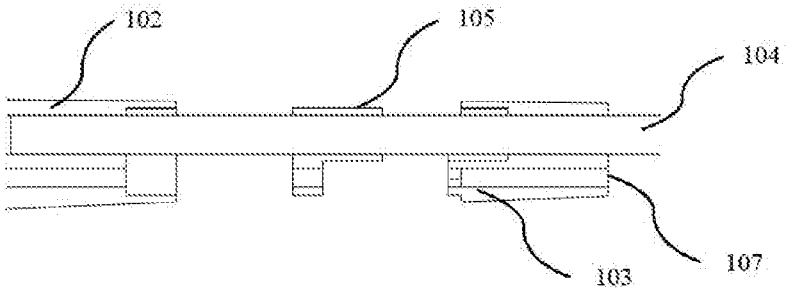
FIG. 6 is a schematic cross-section view showing the parts of FIG. 4 in a separate state.
Figure 7:
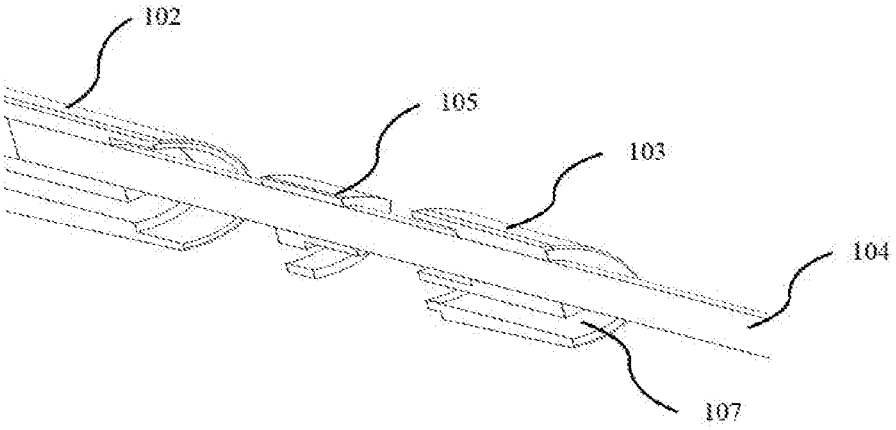
FIG. 7 is a schematic perspective view of the parts of FIG. 5.

FIG. 6 is a schematic cross-section view showing the parts of FIG. 4 in a separate state. FIG. 7 is a schematic perspective view of the parts of FIG. 5. In FIGS. 6 and 7, the acoustic filter can be omitted.

For example, the assembly element 105 can be used to align the bass tube of the strain relief element 103 with the bass tube in the stem 102. The assembly element 105 can simplify the assembly of the parts of the earphone.

Figure 8:
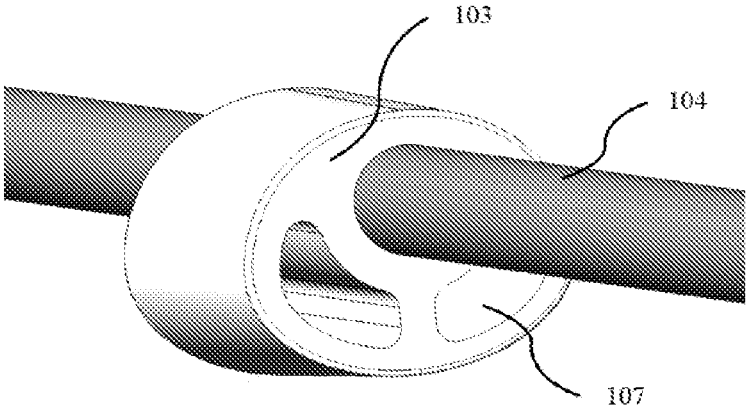
FIG. 8 is a schematic stereogram of a strain relief element of an earphone according to an embodiment of the present invention.

FIG. 8 shows a schematic stereogram of a strain relief element of an earphone according to an embodiment of the present invention. As shown in FIG. 8, the strain relief element 103 firmly surround the cable 104 and has two bass tubes 107. As shown in FIG. 8, the two bass tubes 107 are symmetric with respect to the middle line traversing the cable tube of the strain relief element 103.

Figure 9:
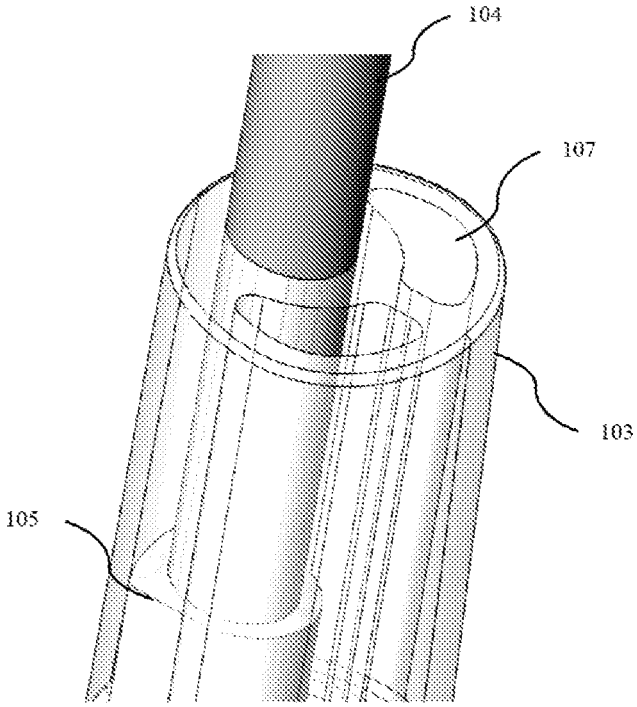
FIG. 9 is another schematic stereogram of a strain relief element of an earphone according to an embodiment of the present invention.

FIG. 9 is another schematic stereogram of a strain relief element of an earphone according to an embodiment of the present invention. It can be seen from FIG. 9, the assembly element 105 extends into the strain relief element 103.

It can also be seen in FIG. 9 that the bass tubes 107 extend in its full size through the relief element 103. For example, the bass tubes 107 in the strain relief element 103 has the same cross-sections as the bass tubes in the stem 102, especially at the connecting positions between the strain relief element 103 and the stem 102. In this way, while ensuring the bass tubes go through the stem 102 and the strain relief element 103 continuously and smoothly, the bass tubes can extend its size as large as possible.

In another embodiment, the present invention can also include an electronics package which includes an electronics apparatus and an earphone according to the present invention. For example, a mobile phone package where a mobile phone and an earphone according to the present invention is placed.

Although some specific embodiments of the present invention have been demonstrated in detail with examples, it should be understood by a person skilled in the art that the above examples are only intended to be illustrative but not to limit the scope of the present invention.

What is claimed is:

1. An earphone, comprising:

an earbud, wherein a cable comes out from an open end of a stem of the earbud; and a strain relief element mounted at the open end, the material of which is softer than that of the stem, wherein the strain relief element contains a cable tube, the cable passes through the cable tube, and the inner wall of the cable tube fits the cable in a close manner, and wherein the strain relief element has at least one bass tube which communicates with at least one bass tube of the earbud.

2. The earphone according to claim 1, further comprising an assembly element, which connects the stem and the strain relief element and the material of which is harder than that of the strain relief element.

3. The earphone according to claim 2, wherein the assembly element surrounds the cable and clamps the cable.

4. The earphone according to claim 2, wherein the assembly element is glued to the strain relief element.

5. The earphone according to claim 2, wherein one part of the assembly element is inside the stem and another part of the assembly element is inside the strain relief element.

6. The earphone according to claim 2, wherein the material of the strain relief element is rubber, the materials of the stem and assembly element are plastic.

7. The earphone according to claim 1, further comprising an acoustic filter placed in the at least one bass tube of the strain relief element, wherein the acoustic filter is placed between the assembly element and the stem of the earbud and is carried by the assembly element.

8. The earphone according to claim 1, wherein the at least one bass tube of the strain relief element has a cross-section as that in the stem.

9. The earphone according to claim 1, wherein it has the same cross-section throughout the length of one bass tube in the strain relief element and the connected bass tube in the stem.

10. The earphone according to claim 1, wherein the at least one bass tube of the strain relief element is aligned with the bass tube in the stem through the assembly element.

11. The earphone according to claim 1, wherein the stem and the strain relief element include two or more bass tubes which are symmetric with respect to the middle line traversing the cable tube of the strain relief element.

12. The earphone according to claim 1, wherein the strain relief element is of a size equal to or larger than that of the stem of the earbud at its open end.

13. The earphone according to claim 12, wherein the strain relief element continues the external geometric lines from the stem of the earbud.

* * * * *